US007011228B2

(12) United States Patent
Ordiway

(10) Patent No.: US 7,011,228 B2
(45) Date of Patent: Mar. 14, 2006

(54) SEALABLE CONTAINER COVER

(75) Inventor: Timothy R. Ordiway, Racine, WI (US)

(73) Assignee: S.C. Johnson Home Storage, Inc., Racine, WI (US)

( * ) Notice: Subject to any disclaimer, the term of this patent is extended or adjusted under 35 U.S.C. 154(b) by 0 days.

(21) Appl. No.: 10/306,085

(22) Filed: Nov. 27, 2002

(65) Prior Publication Data

US 2004/0099666 A1 May 27, 2004

(51) Int. Cl.
*B65D 51/00* (2006.01)

(52) U.S. Cl. ..... 220/287; 150/154

(58) Field of Classification Search ..... 220/287, 220/359.1; 215/319; 2/68; 428/35.2, 34.3; 150/154
See application file for complete search history.

(56) References Cited

U.S. PATENT DOCUMENTS

| | | | | |
|---|---|---|---|---|
| 2,064,411 | A * | 12/1936 | Brandstein | 215/321 |
| 2,080,108 | A | 5/1937 | Brandstein | |
| 2,490,451 | A * | 12/1949 | Magid | 156/161 |
| 2,500,549 | A * | 3/1950 | Ketay et al. | 242/160.1 |
| 2,730,720 | A | 1/1956 | Saunders | |
| 2,821,230 | A | 1/1958 | May | |
| 3,133,656 | A | 5/1964 | Foster | |
| 3,168,209 | A * | 2/1965 | Brookins et al. | 150/154 |
| 3,587,113 | A | 6/1971 | Harriague | |
| 3,793,110 | A | 2/1974 | Saunders | |
| 3,852,823 | A | 12/1974 | Jones | |
| 3,862,614 | A | 1/1975 | Kovac | |
| 4,150,763 | A * | 4/1979 | Simpson | 220/701 |
| 4,394,917 | A | 7/1983 | Looser | |
| 4,560,434 | A | 12/1985 | Sato | |
| 4,660,229 | A * | 4/1987 | Harris | 2/209 |
| 4,765,854 | A | 8/1988 | McKeown | |
| 4,797,523 | A * | 1/1989 | Kohnen | 428/131 |
| 4,844,248 | A | 7/1989 | Forberg et al. | |
| 4,901,881 | A | 2/1990 | McElroy | |
| 4,962,849 | A * | 10/1990 | Anderson | 206/45.24 |
| 4,979,548 | A * | 12/1990 | Howard et al. | 150/159 |
| 5,553,733 | A * | 9/1996 | Rosenthal | 428/35.2 |
| 5,709,312 | A | 1/1998 | Lake | |
| 5,881,637 | A * | 3/1999 | Strickel | 99/449 |
| 6,052,825 | A | 4/2000 | Dodd | |
| 6,260,729 | B1 | 7/2001 | Mitchell et al. | |
| 6,276,551 | B1 * | 8/2001 | Miller, II | 220/287 |
| 6,308,853 | B1 | 10/2001 | Jud | |
| 6,351,852 | B1 | 3/2002 | Propp | |
| 6,405,890 | B1 | 6/2002 | Ashley | |
| 2002/0146115 | A1 * | 10/2002 | Zohn et al. | |

(Continued)

FOREIGN PATENT DOCUMENTS

| | | |
|---|---|---|
| EP | 0447563 | 9/1991 |

(Continued)

OTHER PUBLICATIONS

S. C. Johnson & Son, Inc., Saran™ QuickCovers™ Lids, © 2002 web page at (http://www.saranbrands.com/saran_fop_qclids.asp); site describes "QuickCovers™" and shows the product in use, Feb. 5, 2003.

(Continued)

*Primary Examiner*—Lien M. Ngo

(57) ABSTRACT

A sealable container cover includes both an elastic edge and an adhesive edge for sealing the container cover to the wall or walls of a container. The elastic material around the expandable opening of the container cover may be attached directly to the edge of the cover, housed by a hem created at the edge of the cover, or housed by an additional piece of film or other material attached at the edge of the cover.

12 Claims, 3 Drawing Sheets

U.S. PATENT DOCUMENTS

| | | | |
|---|---|---|---|
| 2003/0010415 | A1 * | 1/2003 | Szuszkiewicz |
| 2003/0082320 | A1 | 5/2003 | Toussant et al. |
| 2003/0199841 | A1 | 10/2003 | Ashton et al. |
| 2004/0086205 | A1 | 5/2004 | Raterman |

FOREIGN PATENT DOCUMENTS

| | | | | |
|---|---|---|---|---|
| FR | 2590788 | * | 12/1985 | ..... 150/154 |
| JP | 2002-185761 | * | 7/2000 | ..... 150/154 |
| JP | 2002-336045 | * | 11/2002 | ..... 2/209 |
| NL | 1 001 292 | | 8/1996 | |

OTHER PUBLICATIONS

International Search Report PCT/US 03/37982; Report dated Apr. 26, 2004.

* cited by examiner

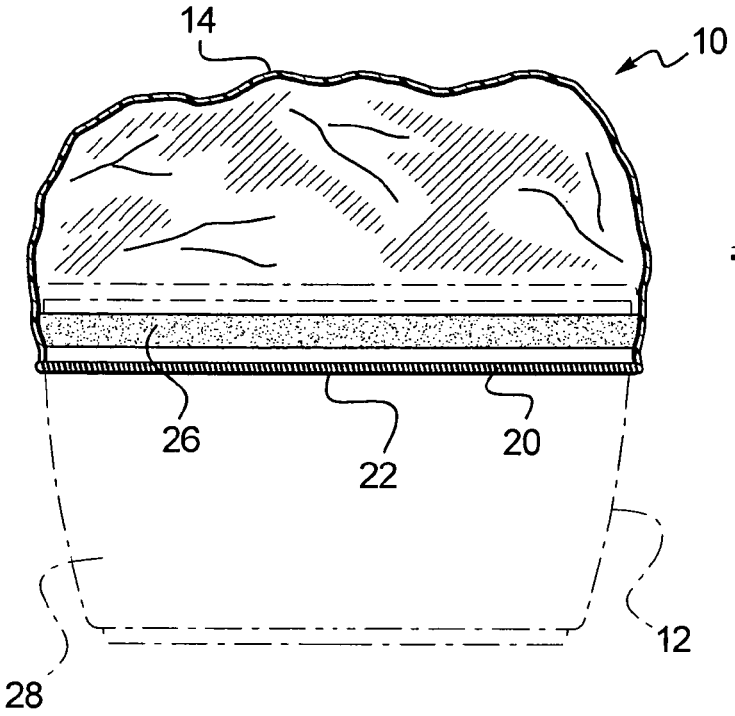
FIG. 4
FIG. 5A
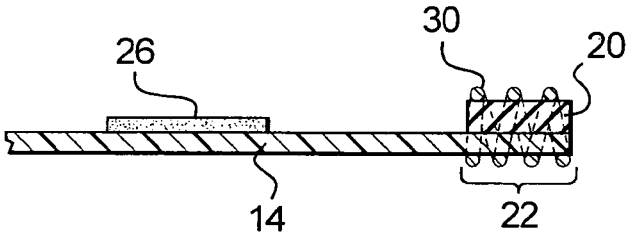
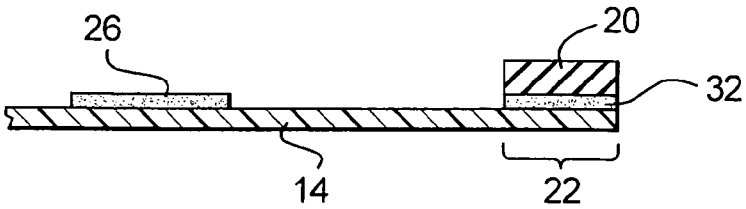
FIG. 5B
FIG. 5C
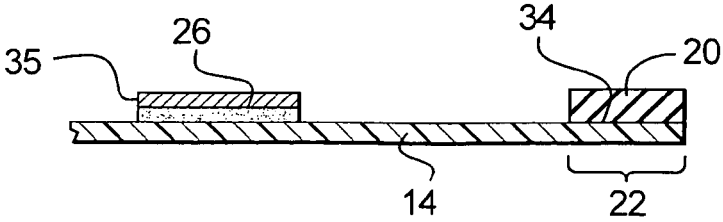

SEALABLE CONTAINER COVER

FIELD OF THE DISCLOSURE

The present disclosure generally relates to container covers. More particularly, the present disclosure relates to container covers having a sealing member.

BACKGROUND OF THE DISCLOSURE

Disposable container covers capable of covering containers of various sizes and shapes have been in use for many years. Such covers typically include a plastic film, such as polyethylene, provided in sufficient dimension to overly the container opening. The film then employs surface tension or elastic bands to secure the film to the container, such as with Saran® wrap or Quick Covers®, respectively, both being products of the present assignee, with the latter having an elastic band sewn directly to the film around its perimeter. The elastic band bordering the film is attached in such a manner that tension is created on the film, thereby creating a hollow enclosure with an expandable opening for placing atop and around containers of various sizes and shapes.

Use of such container covers is common for both perishable and nonperishable items. While these covers are beneficial in many respects, they are not without room for improvement. A common problem with existing container covers is the lack of an effective seal between the cover and the container. This is especially problematic with regard to food storage. First, depending on the size of the container cover relative to the container, the conventional container covers described above are vulnerable to slippage and inadvertent removal from the container. Any attempt at preserving freshness or protecting the contents of the container from exposure to various elements is futile where the container cover does not actually cover the container, but instead, slips off the container.

Even when such conventional covers remain appropriately positioned on a container, their sealing capabilities are limited. More specifically, given the limited constriction afforded by elastic bands, the susceptibility of films to lose surface tension, and/or the irregular shapes of the containers being sealed, air and moisture can flow relatively freely in and out of containers covered with conventional container covers. Consequently, where a substantial or hermetic seal is desired, as opposed to where air or moisture ventilation is desired, the goal of preserving the freshness of perishable items is less likely to be realized with conventional disposable covers.

SUMMARY OF THE DISCLOSURE

In accordance with one aspect of the disclosure, a container cover is provided which comprises a flexible film having elastic attached at the periphery of the film and an adhesive layer proximate the elastic. In accordance with another aspect of the disclosure, a container cover is provided which comprises perforated film, thereby allowing for air and moisture ventilation through the container cover. In accordance with yet additional aspects of the disclosure, container covers are provided wherein the elastic material at the periphery of the film is sewn directly to the film, heat sealed to the film, glued to the film, enveloped by the film, or otherwise attached to the film. Further provided by the present disclosure is a container cover in which adhesive proximate the elastic material is provided with a flexible covering for protection of the adhesive until the desired time of use.

In accordance with another aspect of the disclosure, a method is provided for covering a container which comprises the steps of expanding the opening of a container cover having elastic material around its opening and an adhesive layer proximate the elastic material; placing the cover over a container opening such that the elastic material grips the wall or walls of the container; and pressing the film, opposite the adhesive layer, around the outside of the container, thereby creating a seal between the container cover and the container. Further provided by the disclosure is an additional step of removing a flexible covering from the adhesive layer prior to placing the cover over the container.

These and other aspects and features of the disclosure will become more apparent from the following detailed description when taken in conjunction with the accompanying drawings.

BRIEF DESCRIPTION OF THE DRAWINGS

FIG. 4 is a sectional view of the container cover of FIG. 1, taken along line 4—4 of FIG. 1, depicted in a normal usage state, with the bowl shown in phantom for clarity;

FIGS. 5A–C are sectional views, taken along line 5—5 of FIG. 3, depicting three alternatives for attaching the elastic material directly to the film;

Figure 1:
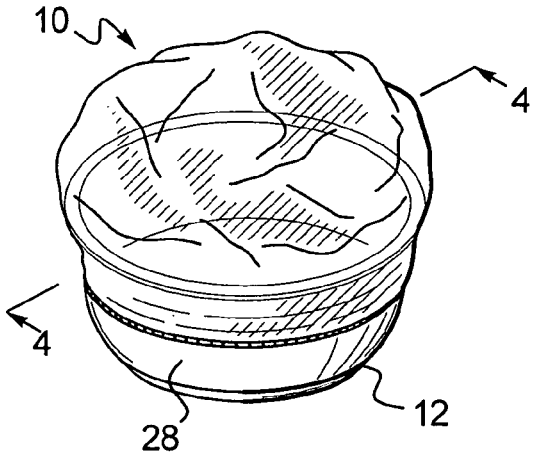
FIG. 1 is a perspective view of a typical container utilizing a container cover constructed in accordance with the teachings of the present disclosure.

While the disclosure is susceptible to various modifications and alternative constructions, certain illustrative embodiments thereof have been shown in the drawings and will be described below in detail. It should be understood, however, that there is no intention to limit the disclosure to the specific forms disclosed, but on the contrary, the intention is to cover all modifications, alternative constructions, and equivalents falling within the spirit and scope of the disclosure as defined by the appended claims.

DETAILED DESCRIPTION OF THE PREFERRED EMBODIMENTS

Referring now to the drawings, and with specific reference to FIG. 1, a container cover constructed in accordance with the present disclosure is generally referred to by reference numeral 10. While the container cover 10 will be described herein with reference to food storage covers for covering containers 12 such as bowls, pots, and pans, it is to be understood that the teachings of the disclosure could be employed for any type of cover, such as, but not limited to, covers used to store perishable goods other than food, as well as, covers for nonperishable goods. Furthermore, while the container cover 10 depicted is constructed using thermoplastic film, such as polyethylene, also embodied by the present disclosure is the use of any flexible film including, but not limited to, other polymers, waxed paper, metallic foil, parchment paper, and the like. In addition, the film from which the container cover 10 is constructed can be perforated, thereby allowing for air and moisture flow through the container cover 10. This characteristic is oftentimes desired, for example, when storing fruit and/or vegetables.

Figure 2:
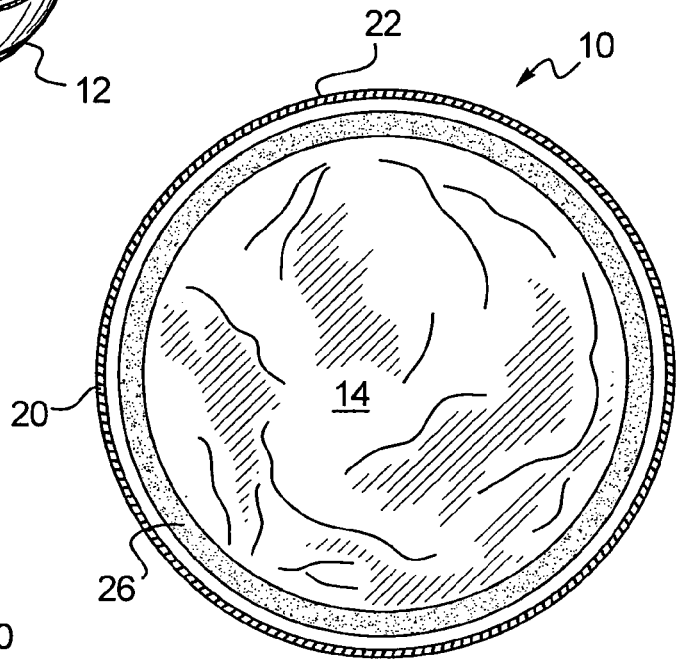
FIG. 2 is a plan view of the container cover of FIG. 1 depicted in a fully expanded state.
Figure 3:
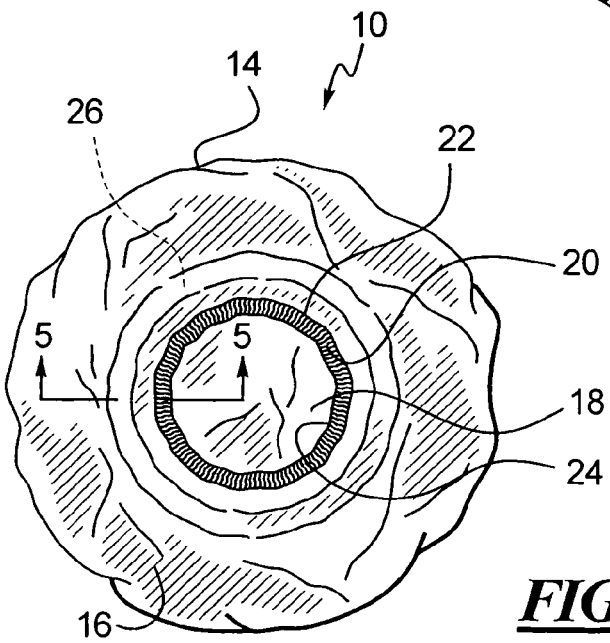
FIG. 3 is a bottom view of the container cover of FIG. 1 depicted in a fully relaxed state.

FIGS. 2–4 illustrate a container cover 10 depicted in three different orientations: fully expanded, fully constricted, and normal usage, respectively. The cover 10 includes a flexible film or base 14 having an outer surface 16 and an inner surface 18. An elastic edging or material 20 is disposed at a periphery 22 of the film 14. As will be described in further detail herein, the elastic material 20 bordering the periphery 22 is attached in such a manner that tension is created on the film 14, thereby creating an expandable opening 24 in the in the container cover 10, as shown best in FIG. 3. In this manner of construction, the container cover 10 defines a hollow body of flexible film 14 with an expandable opening 24 capable of covering containers 12 of various sizes and shapes.

As further depicted in FIGS. 2–4, the container cover 10 may further include an adhesive strip 26 on the inner surface 18 of the film 14, proximate the elastic material 20 which borders the periphery 22. In most of the depicted embodiments, the adhesive strip or layer 26 is exposed; however, it is to be understood that an alternative form of the cover 10 may include a flexible protective strip 35 (as described below with reference to FIG. 5C), such as paper with a release coating, over the adhesive layer 26 for removal by the user prior to covering a container 12. The adhesive layer 26 is depicted in FIGS. 2–4 as a flat strip bonded directly to the inner surface 18 of the container cover 10. However, also embodied by the present disclosure is any adhesive layer including, but not limited to, a pressure-sensitive adhesive, an adhesive foam material, and the like. Furthermore, the adhesive layer 26 may continuously surround the entire opening 24 of the cover 10 proximate the elastic material 20, as illustrated in FIG. 2. Alternatively, the periphery 22 of the container cover 10 could be provided only intermittently with the adhesive layer 26. For instance, the adhesive layer 26 could start and stop at equal or random intervals around the periphery 22, proximate the elastic material 20.

FIG. 4 illustrates the container cover 10 in a normal usage state. This particular embodiment of the container cover 10 is constructed from film 14 cut to form a hemispherical shaped cover 11 when so expanded. However, it is to be understood that the teachings of the disclosure can be employed with equal efficacy to covers of various shapes including, but not limited to, those which are over-semicircular, square, rectangular, or trapezoidal in cross-section. Regardless of the shape, the container covers 10 of the present disclosure, as illustrated in FIG. 4, include an elastic material 20 attached at the periphery 22 of the film 14. The elastic material 20 provides the primary means of closure by gripping a wall or walls 28 of the container 12 being covered, as shown in FIG. 1. Using an elastic material 20 in the construction of the container cover 10 results in an automatically actuated primary closure member. As a secondary means of closure, a manually actuated adhesive layer 26 is provided. As described above in reference to FIGS. 2 and 3, the adhesive layer 26 is situated immediately radially inward of the elastic material 20 bordering the film 14. Alternate forms of adhesive layers may be utilized and are described above.

Also provided by the present disclosure is a method of covering a container 12 using the container covers 10 described above and illustrated by FIGS. 2–4. By expanding the opening 24 of the cover 10 to the appropriate size for a given container 12, the user can place the cover 10 on top of the container 12. With the elastic material 20 and adhesive layer 26 so surrounding the wall or walls 28 of the container 12, the user can then press the outer surface 16 of the film 14, opposite the adhesive layer 26, against the walls 28 of the container 12. If the adhesive layer 26 is pressure-sensitive, this method of covering a container 12 creates a seal between the film 14 and the container 12. As described above with reference to FIG. 5C, an additional embodiment of the disclosure provides for a flexible protective strip 35 over the adhesive layer 26 on the inner surface 18 of the container cover 10. In such an embodiment, an additional step of removing the flexible covering or protective strip 35 from the adhesive layer 26 prior to covering the container 12 is required.

The above referenced manner of positioning a container cover 10 on a container allows for coverage of bowls or containers of various sizes and shapes, and further provides for a more effective seal around the container 12. Specifically, the adhesive layer 26 disposed on the inner surface 18 of the film 14 secures the cover 10 around the container 12 and further prevents the cover 10 from slipping off the container 12. In addition, as opposed to conventional container covers, which merely employ the tension created by the elastic 20 for gripping the walls 28 of their respective containers 12, the container covers 10 of the present disclosure provide an additional adhesive seal 26 between the cover 10 and the container 12, thereby furthering the goal of content preservation.

Further provided by the present disclosure, and illustrated in FIGS. 5–7, are apparatus and methods for attaching the elastic material 20 around the periphery 22 of the film 14. More specifically, FIG. 5 illustrates three alternatives for directly attaching the elastic material 20 at the periphery 22 of the film 14. First, FIG. 5A demonstrates the elastic material 20 as being sewn directly to the periphery 22, with stitches 30 traversing through both the elastic material 20 and the film 14. Depicted immediately adjacent the elastic material 20 is the adhesive layer 26 as described above for FIGS. 2–4. FIG. 5B similarly demonstrates a means for directly attaching the elastic material 20 to the film 14. In this embodiment, the elastic material 20 is attached directly to the film 14 using glue or another comparable adhesive 32. Furthermore, an adhesive layer 26, like those described above, is found adjacent the elastic material 20. Also in accordance with the present disclosure, and as illustrated in FIG. 5C, is a means for attaching the elastic material 20 directly to the film 14 via a weld 34 formed by heat sealing or the like. As in the above-described embodiments, an adhesive layer 26 is included proximate the elastic material 20. As illustrated in FIG. 5C, an additional embodiment of the disclosure provides for a flexible protective strip 35, for removal prior to use, over the adhesive layer 26. While only three embodiments are depicted in FIGS. 5A–C, one skilled in the art will understand that a variety of methods including, but not limited to, co-extrusion, ultrasonic welding, lamination, or the like can be employed for attaching the elastic material 20 directly to the film 14.

Figure 6A:
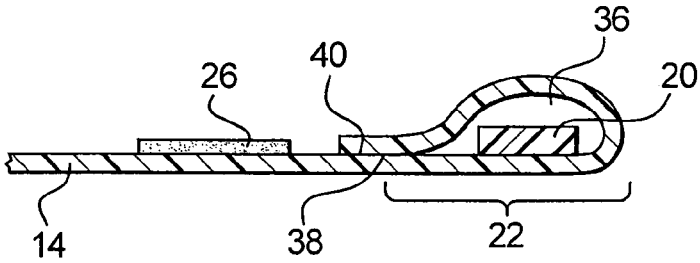
FIGS. 6A–C are sectional views similar to FIGS. 5A–C, depicting three alternative embodiments in which the elastic material is held within a fold at the periphery of the film.
Figure 6B:
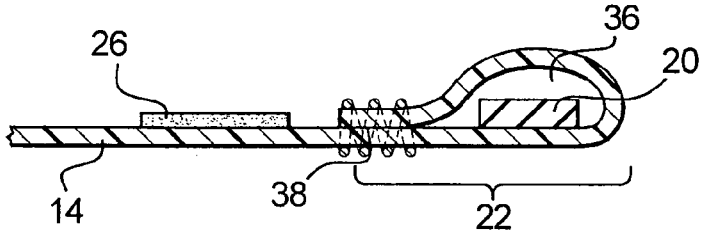
Figure 6C:
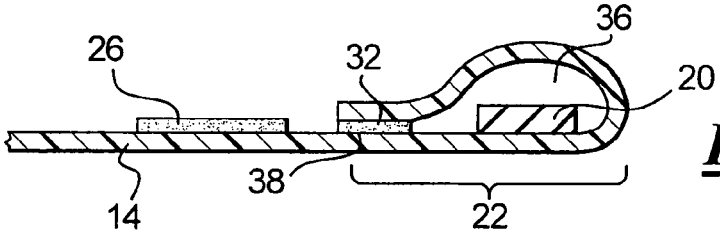

Referring now to FIGS. 6A–C, three additional means are illustrated for attaching the elastic material 20 at the periphery 22 of the film 14. Each of the three embodiments involves holding the elastic material 20 within a fold or hem 36 created at the periphery 22 of the film 14. Specifically, the periphery 22 of the film 14 is folded over and attached to itself at a location 38 immediately interior to the edge, thereby creating the hem 36 for holding the elastic material 20. FIG. 6A demonstrates the elastic material 20 housed within the fold 36 created at the periphery 22 of the film 14 using a heat seal 40 for attachment of the film 14 to itself. Included in this and all embodiments of the disclosure is the adhesive layer 26 adjacent to the elastic material 20. Alternatively, FIG. 6B demonstrates the elastic material 20 housed within the hem 36 created by sewing the film 14 onto itself around the periphery 22 of the film 14. As illustrated in FIG. 6B, the film 14 is folded over and sewn, thereby creating the hem 36 for housing the elastic material 20. Again, this embodiment includes an adhesive layer 26 proximate the elastic material 20. FIG. 6C, like FIGS. 6A and 6B, depicts an additional embodiment of the present disclosure wherein the elastic material 20 is housed within a fold 36 created at the periphery 22 of the film 14. Here, however, the fold 36 is created by attaching the film 14 to itself using glue or another comparable adhesive 32. Adjacent the hem 36 is the adhesive layer 26, as described in the above-disclosed embodiments. It will further be understood by one with skill in the art that a variety of manners including, but not limited to, co-extrusion, ultrasonic welding, lamination, or the like can be used to attach the film to itself, thereby creating the hem 36 along the periphery 22 of the film 14 for housing the elastic material 20.

Figure 7A:
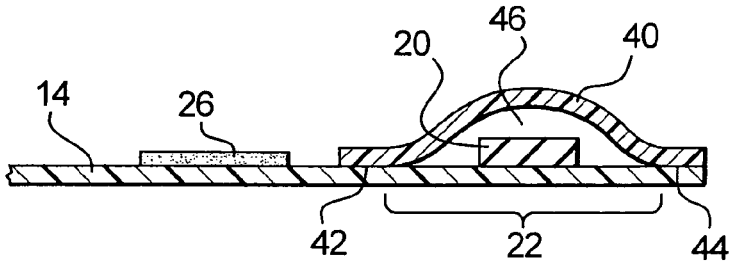
FIGS. 7A–C are sectional views similar to FIGS. 5A–C, depicting three alternative embodiments in which the elastic material is held within a compartment at the periphery of the film using an additional layer of film.
Figure 7B:
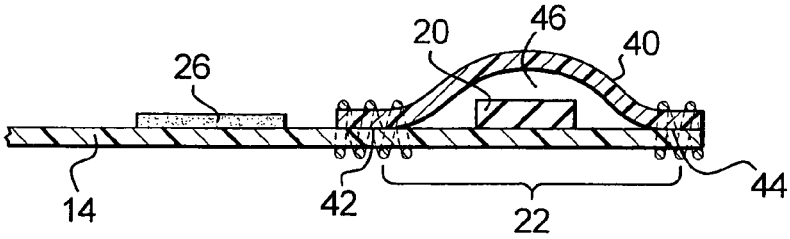
Figure 7C:
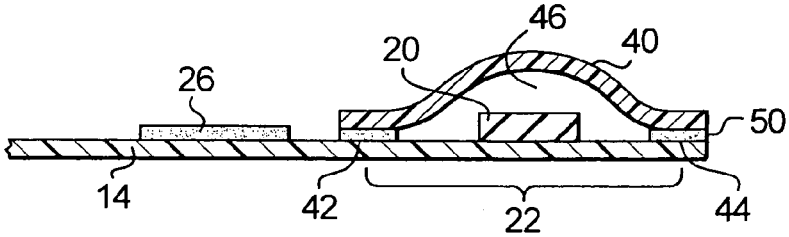

Referring now to FIGS. 7A–C, provided by the present disclosure are additional means for attaching the elastic material 20 at the periphery 22 of the film 14. Specifically, FIGS. 7A–C illustrate the use of a separate layer of film or cover material 40 attached at locations 42, 44 along the periphery 22 of the film 14, thereby creating a compartment 46 for housing the elastic material 20. FIG. 7A, for example, attaches the cover material 40 to the film 14 via a heat seal between the cover material 40 and the film 14 at two locations 42, 44 positioned on opposite sides of the elastic material and along the periphery 22 of the film 14. Alternatively, as illustrated in FIG. 7B, the cover material 40 can be attached to the film 14 via stitches that traverse both the cover material 40 and the film 14. Further provided by the present disclosure and illustrated in FIG. 7C is a method for attaching the cover material 40 to the film 14 using glue or other comparable adhesive 48, 50. Again, one skilled in the art would further understand that a variety of manners including, but not limited to, co-extrusion, ultrasonic welding, lamination, or the like could be employed for attaching the cover material to the film. Further, included in each of the embodiments illustrated in FIGS. 7A–C is the adhesive layer 26 adjacent to the elastic material 20.

While certain representative embodiments and details have been shown for purposes of illustrating the disclosure, it will be apparent to those skilled in the art that various changes in the methods and apparatus disclosed herein may be made without departing from the scope of the disclosure, which is defined in the appended claims.

What is claimed is:

1. A container cover, comprising:

a flexible film having an outer surface and an inner surface;

elastic material coupled to a periphery of the film and extending in a continuous loop around the periphery of the film, the elastic material forming a primary closure member for attachment of the cover to a container; and an adhesive layer disposed on the inner surface of the film, the adhesive layer being interior to and separate from the elastic material, the adhesive layer forming a continuous loop around the film and forming a secondary closure member for attachment of the cover to a container.

2. The container cover of claim 1, wherein the flexible film is a plastic material.

3. The container cover of claim 1, wherein the flexible film is perforated.

4. The container cover of claim 1, wherein the elastic material is sewn directly to the film.

5. The container cover of claim 1, wherein the elastic material is glued directly to the film.

6. The container cover of claim 1, wherein the elastic material is heat sealed directly to the film.

7. The container cover of claim 1, wherein the elastic material is housed within a fold at the periphery of the film.

8. The container cover of claim 1, wherein a cover layer is attached to the periphery of the film to form a compartment sized to receive the elastic material.

9. The container cover of claim 1, further including a flexible covering provided over the adhesive material, the flexible covering being removable prior to use.

10. The container cover of claim 1, wherein the adhesive material is pressure-sensitive.

11. A method of covering a container, comprising the steps of:

providing a flexible film having an outer surface and an inner surface, elastic material coupled to a periphery of the film to define an expandable opening, and an adhesive layer disposed on the inner surface of the film, the adhesive layer being interior to and separate from the elastic material, the elastic material forming a continuous loop around the film and forming a primary closure member for attachment of the cover to a container, the adhesive layer forming a continuous loop around the film and forming a secondary closure member for attachment of the cover to a container;

expanding the opening to a size sufficient to receive the container;

placing the film over the container so that the opening surrounds a wall of the container;

releasing the opening so that the elastic material engages the container wall with the primary closure member; and pressing the outer surface of the film in an area opposite the adhesive layer inwardly toward the container wall, thereby creating a seal between the film and the container wall with the secondary closure member.

12. The method of claim 11, further including removing a flexible covering from the adhesive layer prior to covering the container.

* * * * *